United States Patent [19]

Abellana et al.

[11] Patent Number: 5,049,727

[45] Date of Patent: Sep. 17, 1991

[54] LOCKING DEVICE FOR REMOVABLE POSTAGE METER

[75] Inventors: Jovito N. Abellana, Trumbull; Danilo P. Buan, Easton, both of Conn.

[73] Assignee: Pitney Bowes Inc., Stamford, Conn.

[21] Appl. No.: 291,462

[22] Filed: Dec. 28, 1988

[51] Int. Cl.[5] ..... G07G 1/00

[52] U.S. Cl. ..... 235/101; 235/58 P; 235/130 R

[58] Field of Search ..... 235/101, 3, 58 P, 130 R; 101/91

[56] References Cited

U.S. PATENT DOCUMENTS

| | | | |
|---|---|---|---|
| 2,554,296 | 5/1951 | Crews | 70/174 X |
| 2,746,382 | 5/1956 | Hanson | 235/130 R |
| 2,795,186 | 6/1957 | Bach et al. | 101/269 |
| 3,502,266 | 3/1970 | Clemons | 235/101 |
| 3,926,019 | 12/1975 | Mazeika | 70/85 |
| 4,283,721 | 8/1981 | Eckert et al. | 340/680 |
| 4,321,867 | 3/1982 | Soderberg et al. | 101/91 |
| 4,506,344 | 3/1985 | Hubbard | 235/101 X |
| 4,508,260 | 4/1985 | Keir et al. | 232/43.1 |
| 4,523,523 | 6/1985 | Abellana et al. | 101/93 X |
| 4,559,444 | 12/1985 | Erwin et al. | 235/101 |
| 4,579,054 | 4/1986 | Baun et al. | 101/91 |
| 4,655,391 | 4/1987 | Granzow et al. | 232/43.1 |
| 4,796,526 | 1/1989 | Erwin | 101/65 |
| 4,796,527 | 1/1989 | Erwin | 101/70 |

*Primary Examiner*—Benjamin R. Fuller
*Assistant Examiner*—Nancy Le
*Attorney, Agent, or Firm*—Charles G. Parks, Jr; David E. Pitchenik; Scolnick

[57] ABSTRACT

A postage meter having a movable shutter covering the printing die of the meter and mechanisms associated either with the postage meter or a meter base for locking the shutter and moving it, are disclosed. In one embodiment a keyswitch is provided which control locking and unlocking of the shutter and its movement. The meter base locks the postage meter therein with unlocking being controlled by the keyswitch.

11 Claims, 13 Drawing Sheets

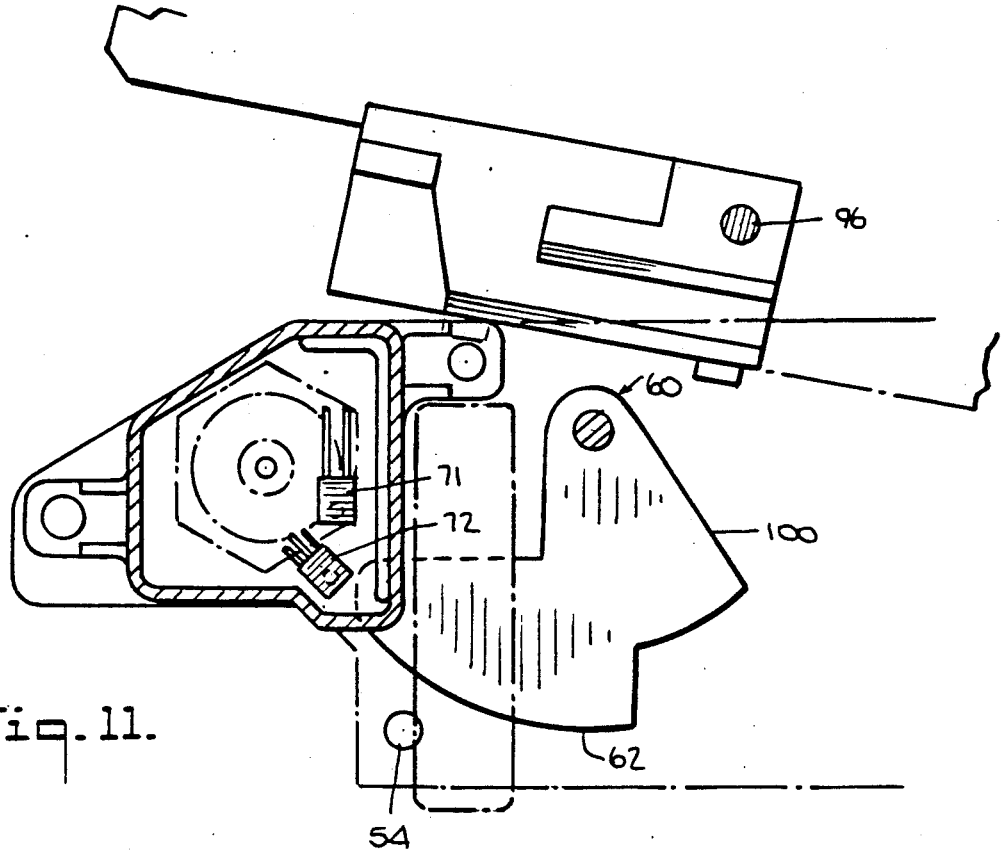
Fig. 11.
Fig. 12.
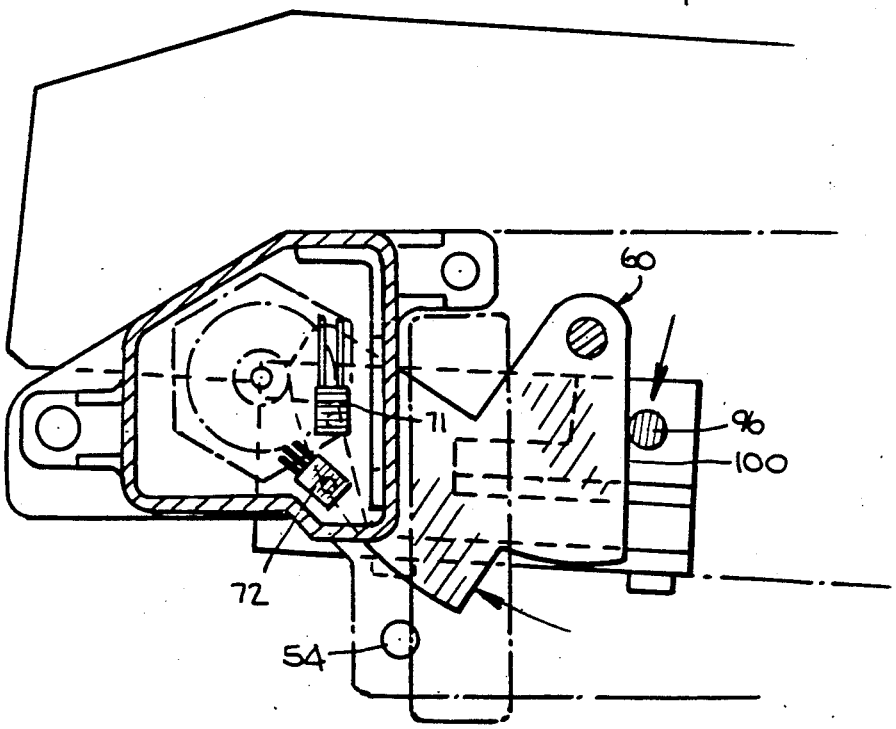

Fig. 13.
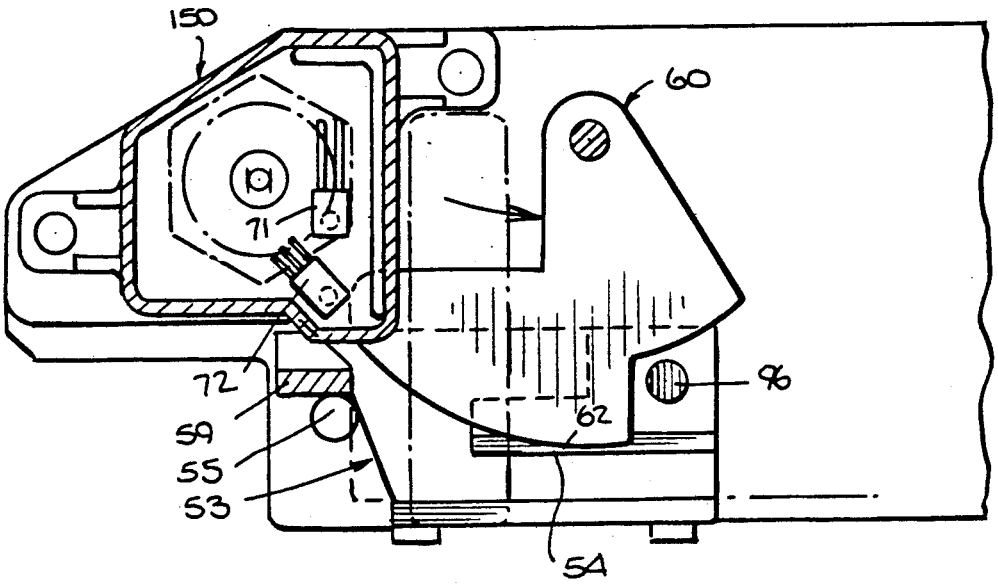
Fig. 14
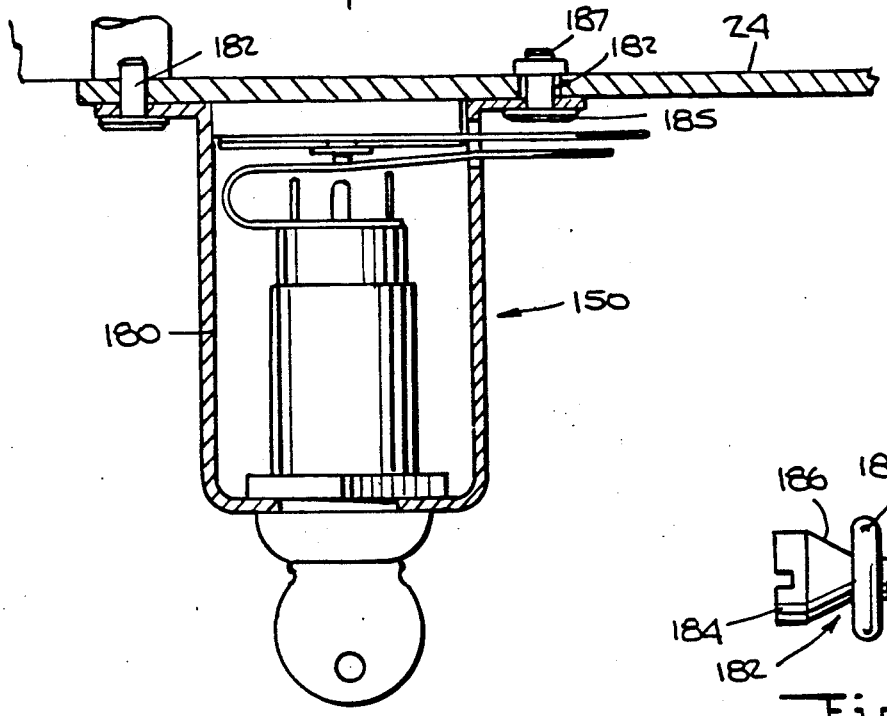
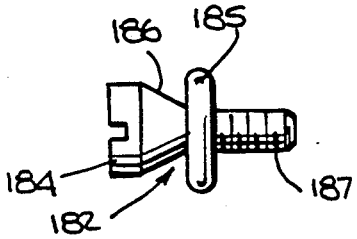
Fig. 15.

LOCKING DEVICE FOR REMOVABLE POSTAGE METER

RELATED APPLICATIONS

The following patent applications disclose a removable postage meter and security devices therefor including a shutter or die cover plate which covers the print die of a postage meter and is selectively moved to expose the print die: U.S. Pat. No. 4,876,956 entitled A REMOVABLE POSTAGE METER HAVING AN INDICIA COVER filed on Oct. 27, 1987; application Ser. No. 114,361 entitled DIE PROTECTION ASSEMBLY FOR PREVENTING FRAUDULENT PRINTING BY AN ELECTRONIC POSTAGE METER filed on Oct. 27, 1987; and application Ser. No. 114,358 entitled PRINTWHEEL SETTING DEVICE FOR A POSTAGE METER filed on Oct. 27, 1987; all assigned to the assignee of this application.

Application Ser. No. 291,483 entitled HIGH THROUGHPUT MAILING MACHINE TIMING filed on even date herewith, discloses a timing and control system for a mailing machine in which the postage meter and locking device disclosed herein may be used.

The disclosures of all of the above applications are incorporated herein by reference.

BACKGROUND OF THE INVENTION

The invention relates to postage meters, more particularly flat-bed printing meters, and to security and control devices therefor.

Electronic meters of the flat-bed printer type are well-known and are described for example in U.S. Pat. No. 4,579,054, issued to Buan, et al, which shows a stand-alone electronic mailing machine in which the electronic postage meter forms an integral part of the device. Other aspects of such a stand-alone mailing machine are described in U.S. Pat. Nos. 4,535,407 and 4,523,523, among others.

Of particular concern in postage meters and mailing machines is the prevention of unauthorized printing of a meter impression. That is, since the printing of the impression assumes that the Post Office has been paid for the delivery of the mailpiece, the making or "wiping" of a print without accounting for the value will result in loss of revenue to the Post Office to cover the costs of delivery. It will be appreciated that in an area of such concern, many devices have been developed to solve problems associated with the security of the printing die.

Die protection assemblies incorporate various mechanical arms of projections which protrude from the printwheel area of the die in order to prevent a person from simply placing an envelope against the die to obtain an imprint.

U.S. Pat. No. 2,795,186 issued to Bach shows a movable shroud which can be lowered to guard the printing die against taking unauthorized impressions at any time between printing operations. The shroud completely covers the face of the value printing die when the printing mechanism is not in an operating cycle and is locked in that position until the cycle starts at which time the shroud is moved to a position uncovering the die. U.S. Pat. No. 4,559,444 issued to Erwin et al. teaches an interposer arrangement which extends upward from the platen into the space into which an envelope or other workpiece is to be inserted. These interposers are moved out of the way during a legitimate printing operation. The interposer blades are mechanically linked to the inking mechanism in order to move the blades out of the way as the mailpiece moves into position for imprinting. U.S. Pat. No. 4,796,527, entitled VALUE PRINTING DIE PROTECTION DEVICE IN AN ELECTRONIC POSTAGE METER MACHINE and U.S. Pat. No. 4,796,527, entitled VALUE PRINTING DIE PROTECTION MECHANISM IN A POSTAGE METER MACHINE, both assigned to the assignee of this application, describe interposer devices which are linked to the motor driving the platen of the printer to move out of the way or actuated by a power switch to be moved out of the way so long as power is applied to the machine.

While these known devices work well in the particular environments in which the platen and the die are not expected to be physically separated, in a modular device where the platen is retained, several new security and control issues are created in respect of a flat-bed printer type of postage meter.

SUMMARY OF THE INVENTION

It is an object of the invention disclosed herein to provide an improved system for locking and unlocking a cover of a postage meter movable to give access to a printing die of a printing device in the postage meter.

It is another object of the invention to provide an improved system for moving the cover between positions giving and denying access to the printing die.

It is another object of the invention to provide an improved receptacle or postage meter base for receiving a postage meter therein.

It is another object of the invention to provide a locking device or lockable postage meter base for receiving and locking therein a postage meter.

It is another object of the invention to provide such a receptacle and locking device which incorporates means for locking and unlocking the postage meter cover.

It is another object of the invention to provide such a receptacle and locking device which incorporates means for moving the postage meter cover between positions giving access and denying access to the printing die.

It is another object of the invention to provide a system for determining the position of a postage meter relative to a receptacle or base holding the postage meter.

It is another object of the invention to provide a system for determining the positional status of the postage meter cover referred to above.

It is another object of the invention to provide a key actuated system which controls locking and unlocking of a postage meter in a receptacle or locking device or postage meter base and/or which controls movement of the postage meter cover described above.

The above and other objects are achieved by the invention disclosed herein which provides combinations of a postage meter including the movable cover, a locking device for the cover, a receptacle, locking device or base for the postage meter, and means performing one or more of the functions described herein; specifically, sensing loading and locking of the postage meter into the base, sensing positioning of postage meter in a predetermined position in the base, sensing the status of the movable postage meter cover, moving the postage meter cover, locking and unlocking the postage meter cover, unlocking the postage meter from the base and sensing same, and performing certain functions in response to a keyswitch and/or a control system.

In a specific embodiment, the postage meter comprises a housing, a printing device disposed in the housing, an aperture in the housing exposing the printing device to the exterior of the housing, a cover for the aperture, means mounting the cover to the postage meter for movement of the cover from a closed position in which the cover is disposed at the aperture denying access to the printing device, and an open position in which the cover is disposed away from the aperture. The cover is structured to prevent access to the printing device when the cover is in the open position and to permit access to the printing device when the cover is in the open position, and the receptacle includes first engaging means for engaging the cover in a predetermined position of the postage meter, and driving means for driving the first engaging means to move the cover between the closed and open positions thereof.

In a specific embodiment, the receptacle or base comprises a first receptacle part (e.g., a meter pocket) and second receptacle part (e.g., a locking device) and means coupling the first and second receptacle parts together such that the first receptacle part is pivotal between a first position thereof in which the first receptacle part forms an angle with the second receptacle part and a second position thereof in which the first receptacle part is within the second receptacle part. The first receptacle part includes means for receiving a first end of the postage meter therein when the first receptacle part is in the first position, and the second receptacle part includes second engaging means for engaging a second end of the postage meter therein when the first receptacle part is in its second position within the first receptacle part. In a preferred embodiment, the first engaging means and the driving means are mounted to the second receptacle part.

One combination of the invention comprises the locking device which includes means for locking the postage meter therein in a predetermined position thereof, first engaging means for engaging the postage meter cover in the predetermined position of the postage meter, and driving means for driving the first engaging means to move the cover between the closed and open positions thereof; and a control system which comprises means for determining when the postage meter is locked in the predetermined position and means for controlling the driving means. In this combination, the controlling means permits the driving means to move the cover only when the postage meter is locked in the predetermined position.

In one embodiment, the control system comprises a key settable switch having a plurality of switch positions set by a key and means for controlling the driving means in response to the positions of the switch, the controlling means causing the driving means to move the cover from the closed position to the open position when the postage meter is in the predetermined position and the switch is switched from a first state thereof to a second state thereof.

Another combination of the invention comprises a postage meter locking device which includes locking means for locking the postage meter therein in a predetermined position thereof and means for actuating the locking means to lock and unlock the postage meter; and a control system which comprises a key settable switch having a plurality of switch positions set by a key and means for controlling the actuating means to cause the actuating means to unlock the postage meter when the switch is switched from a first state thereof to a second state thereof.

Another combination comprises a postage meter locking device which includes the locking means, the driving means for driving the first engaging means and the means for actuating the locking means to lock and unlock the postage meter; and a control system which comprises a key settable switch having a plurality of switch positions set by a key, means for controlling the driving means in response to the positions of the switch, the controlling means causing the driving means to move the cover from the closed position to the open position when the postage meter is in the predetermined position and the switch is switched from a first state thereof to a second state thereof, and means for controlling the actuating means to cause the actuating means to unlock the postage meter when the switch is switched to the first state thereof from another state thereof. A locking means disposed in the postage meter for selectively locking the cover may also be provided which is actuable by the control system when the switch is switched from the first state to another state thereof.

The invention also provides a housing for the switch and tamper resistant means for attaching the housing to the postage meter device.

BRIEF DESCRIPTION OF THE DRAWINGS

FIG. 11 is a side view partially in section of the portion of the postage meter and locking device which lock the postage meter in a predetermined position, showing the postage meter being pivoted into the locking device.

FIG. 12 is a view similar to that of FIG. 11 showing the postage meter partially pivoted into the locking device short of being seated therein;

FIG. 13 is a view similar to that of FIG. 12 showing the postage meter fully seated in the locking device in the predetermined position;

FIG. 14 is a section view of a key lock switch of the locking device;

FIG. 15 is a side view of a break-away screw used to fasten the housing of the key lock switch to the locking device; and FIG. 16 is a block diagram of a control system controlling movement of the shutter and locking of the postage meter.

DESCRIPTION OF THE PREFERRED EMBODIMENTS

Figure 1:
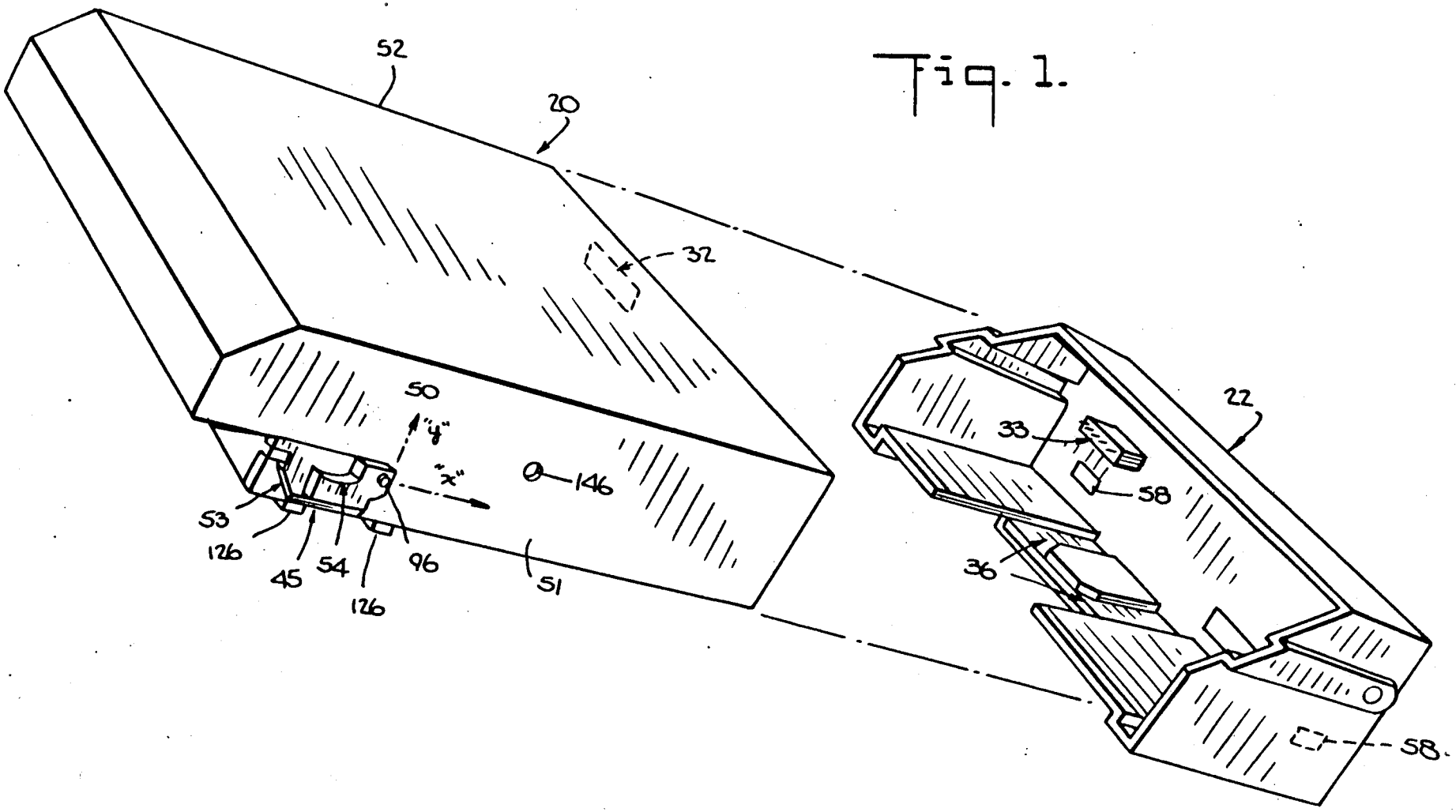
FIG. 1 is a top, exploded perspective view of a postage meter according to the invention and a meter pocket according to the invention into which the postage meter is seated for use in a mailing machine.
Figure 3:
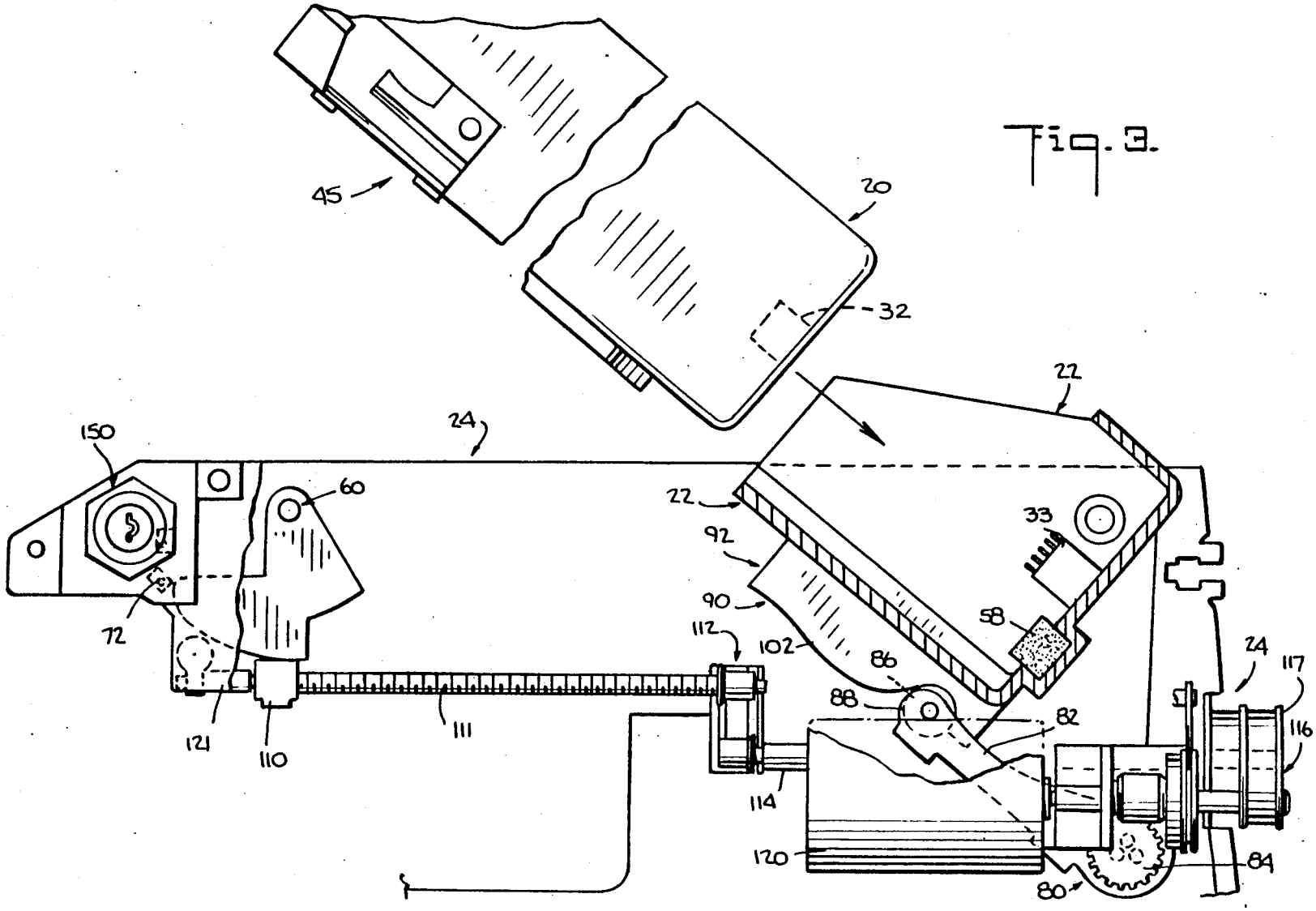
FIG. 3 is a side view, partially in section, of the postage meter and meter pocket depicted in FIG. 1 and a locking device according to the invention into which the postage meter and meter pocket are seated and locked, the postage meter and the meter pocket being shown exploded as in FIG. 1.

Referring to FIG. 1, postage meter 20 is insertable and removable from postage meter pocket 22, which in turn is pivotally mounted to postage meter locking device 24 (FIG. 3). Meter pocket 22 and locking device 24 form a base for postage meter 20. Postage meter 20 includes a printing device 26 (FIG. 16) for printing postage indicia and related indicia such as a town seal, slogans, advertising, etc., and circuitry and structure for setting printing device 26 to print desired indicia, entering authorized postage amounts, and for record keeping of various items such as postage dispensed, postage remaining, etc. Locking device 24 in the disclosed embodiment forms part of a mailing machine 26 (FIG. 5) which may include a transport device 27 including transport rollers 31 (FIG. 6), an inking device 28 which imparts ink to a print die 29 (FIG. 9) of printing device 26 in the postage meter, and a platen device 30 which tamps an ink pad of inking device 28 against print die 29 to ink it, and also tamps a mail piece or tape against print die 29 to imprint postage and other indicia thereon. The mailing machine and various parts thereof are described in related application Ser. No. 291,483 referred to above. Postage meter 20, meter pocket 22 and locking device 24 may also be constructed as a module to be utilized alone or as part of a larger machine.

Figure 2:
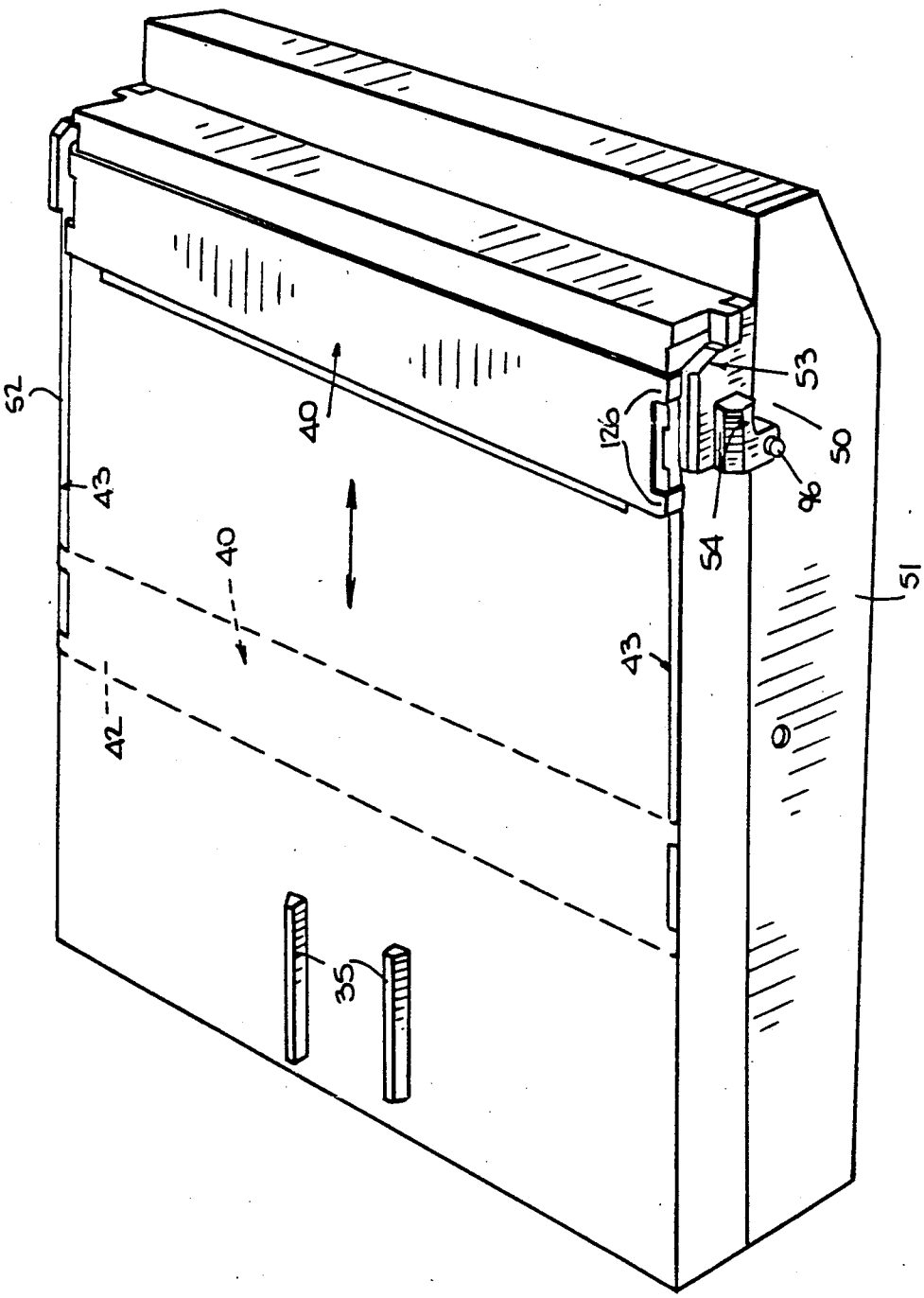
FIG. 2 is a bottom perspective view of the postage meter depicted in FIG. 1.

Postage meter 20 and meter pocket 22 include mating connectors 32, 33 by means of which signals are exchanged between postage meter 20, locking device 24, and, in the disclosed embodiment, among meter 20, locking device 24 and mailing machine 26. Connectors 32, 33 also supply power to postage meter 20. Referring to FIGS. 1 and 2, postage meter 20 and meter pocket 22 include mating dovetail structure 35, 36 for aligning postage meter 20 in meter pocket 22 so that connectors 32 and 33 electrically and mechanically engage when meter 20 is fully seated in pocket 22. Postage meter 20 may be unseated from meter pocket 22 (see FIG. 1) and removed for postage entry, inspection, servicing, etc., or for gaining access to parts of mailing machine 26 for servicing, ink cartridge replacement, etc.

Figure 4:
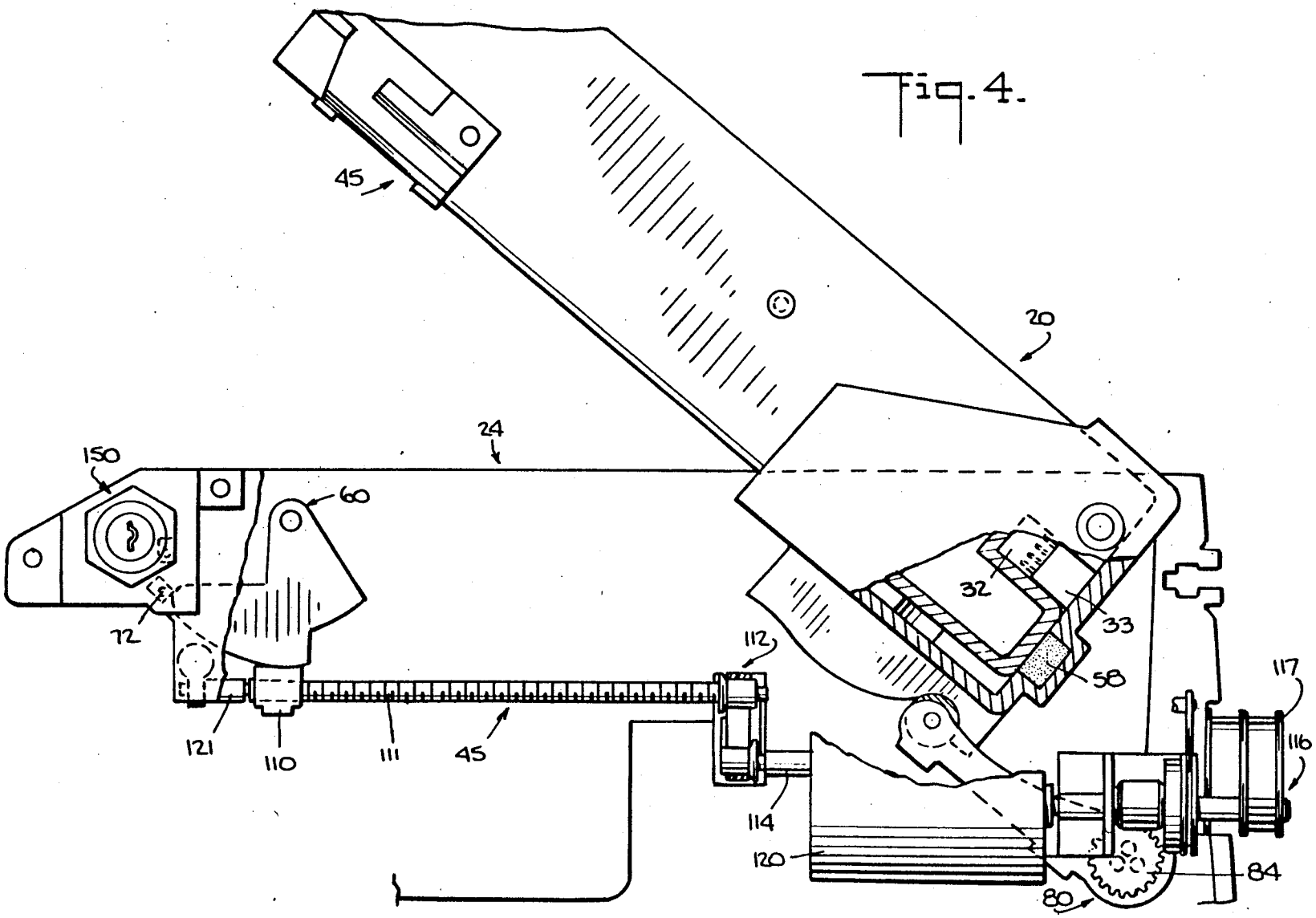
FIG. 4 is a view similar to that of FIG. 3 with the postage meter seated in the meter pocket.
Figure 5:
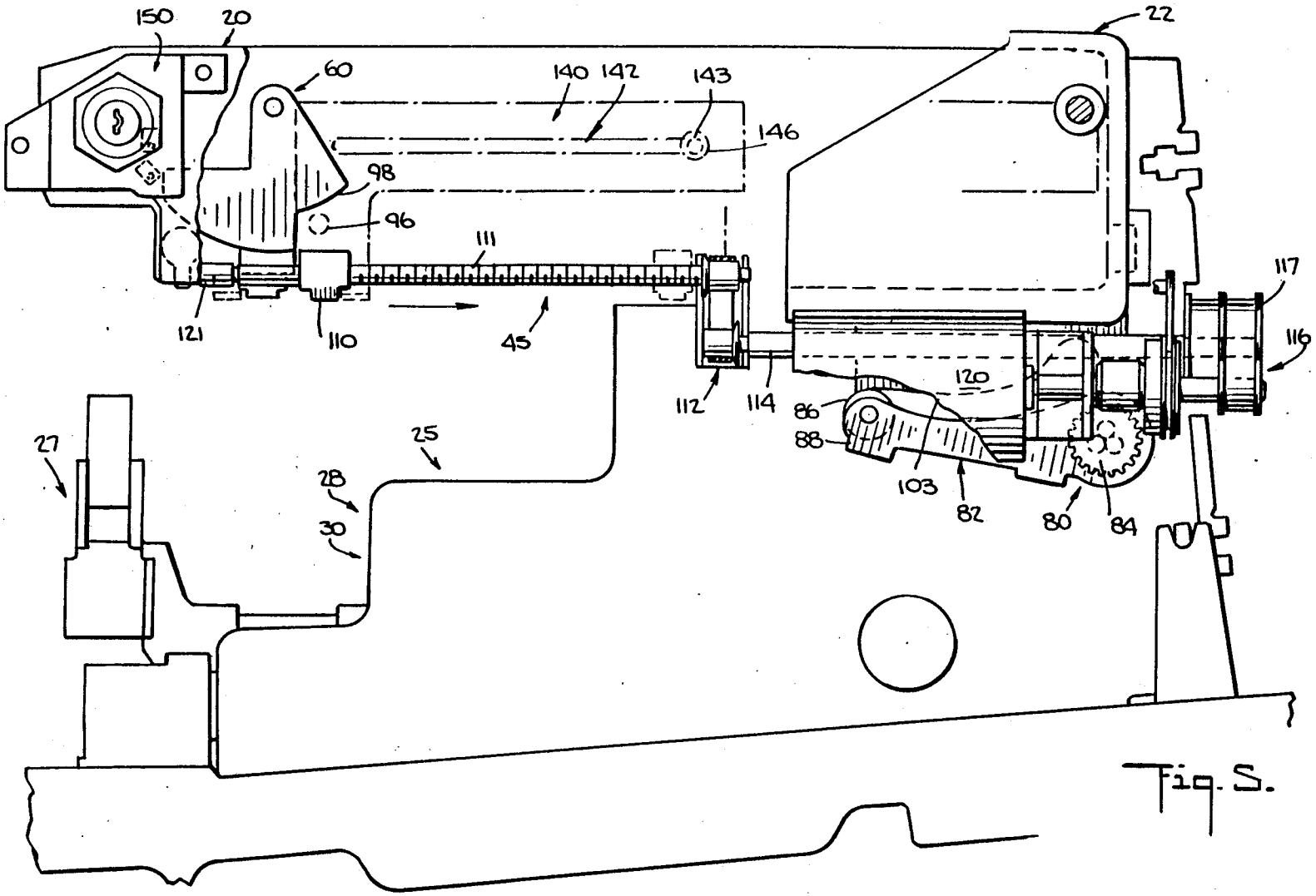
FIG. 5 is a side view, partially in section and partly broken away, of the postage meter, meter pocket and locking device depicted in FIGS. 3 and 4, with the postage meter and meter pocket seated and locked in the locking device in a wait position, this figure also showing part of a mailing machine of which the forms part.
Figure 6:
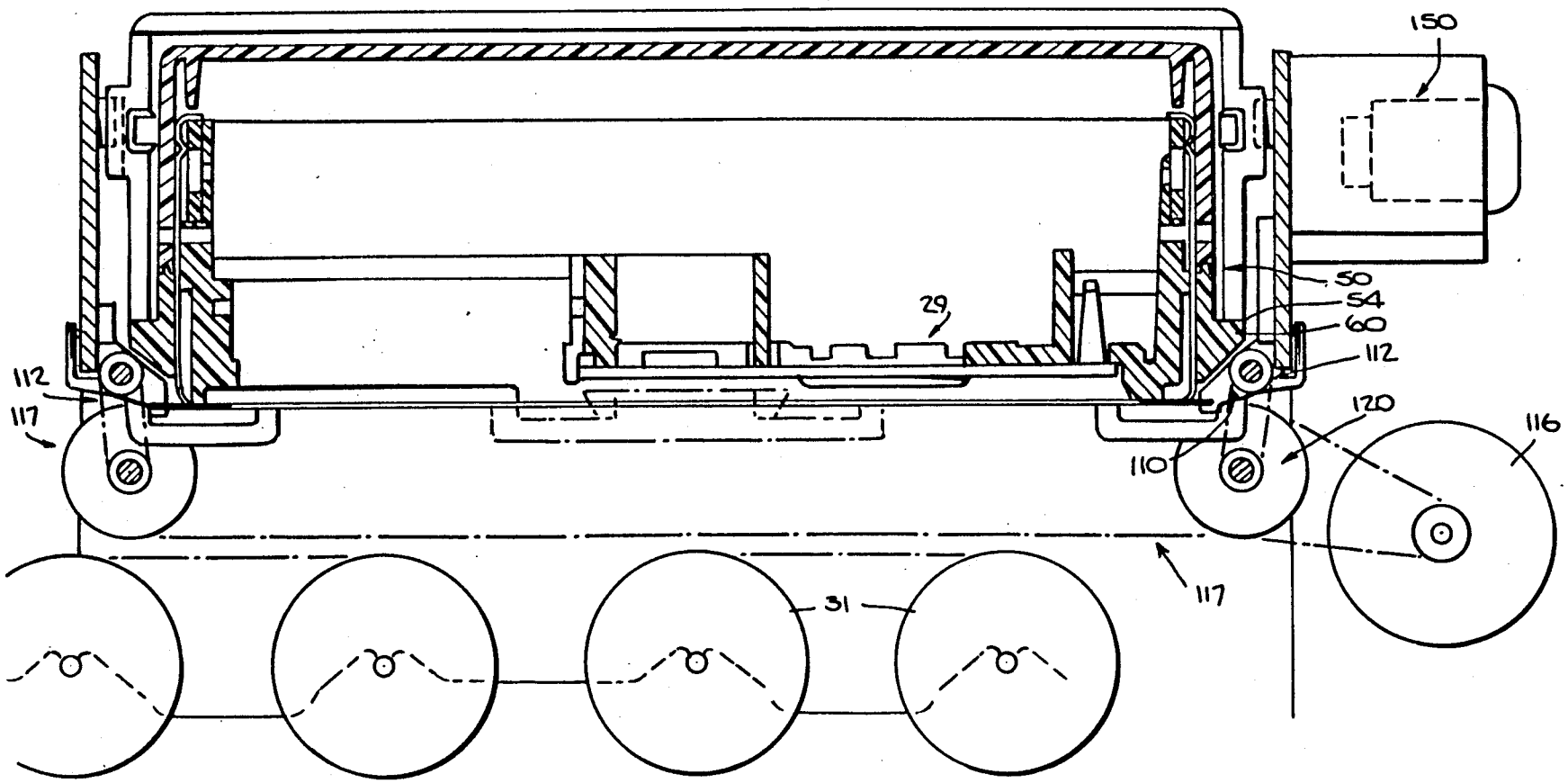
FIG. 6 is a section view taken transversely through the postage meter, locking device and mailing machine depicted in FIG. 5.

Referring to FIG. 2, postage meter 20 includes a shutter bar or cover 40 which in its closed position (FIG. 2) covers print die 29 to protect same, to prevent unauthorized use of meter 22 and to inhibit tampering. Shutter bar 40 is movable to its open position, illustrated by broken lines in FIG. 2, at the ends 42 of shutter bar guide slots 43 to expose print die 29. Referring to FIGS. 3-5, meter 20 is loaded and locked into and by locking device 24 by first seating meter 20 in pocket 24 (FIGS. 3 and 4), and then pivoting meter 20 seated in pocket 22 into locking device 24 (FIG. 5). Once meter 20 is locked into locking device 24, shutter bar 40 may be retracted to its open position (to the right in FIG. 5) by drive mechanism 45 ready to imprint postage indicia on mail pieces and/or tape.

When inserted for use in mailing machine 26, postage meter 20 must be accurately positioned relative to the mailing machine particularly for high speed operation of the mailing machine. Locking device 24 and postage meter 20 are therefore provided with means for accurately positioning postage meter 20 along two axes which in the disclosed embodiments are designated as the "x" axis (horizontal) and the "y" axis (vertical). Referring to FIGS. 1 and 2, postage meter 20 includes a locking section 50 disposed on each side 51, 52 of meter 20. Locking section 50 has an "x" axis cam surface 53 and a "y" axis cam surface 54. Locking device 24 includes an "x" axis cam pin 55 (FIG. 13) which, when meter 20 and pocket 22 are pivoted into locking device 24, engages "x" axis cam surface 53 to cam meter 20 deeper into pocket 22. Attached to rear wall 56 of meter pocket 22 are elastic pieces 58 made, for example, of foam, which are compressed when meter 20 is cammed into pocket 22 and act as springs to accurately position and maintain meter 20 along the "x" axis. Cushion 59 made of rubber for example, (FIG. 14) is compressed by pin 55 during loading to permit locking. Thereafter, pin 55 moves into its locked position as shown in FIG. 13 and cushion 59 recovers. Locking device 24 also includes pivotally mounted latching lever 60 (FIG. 13) having a "y" axis cam 62 which engages "y" axis cam surface 54 to cam postage meter 20 accurately into its seated position with respect to the "y" axis.

A sensing system including send and receive optical sensors 71, 72 (FIG. 11) in locking device 24 cooperate with corresponding sensors 73, 74 (FIG. 16) in postage meter 20 to verify that postage meter 20 is accurately positioned with respect to the "x" and "y" axes The sensors also exchange other information, for example, handshaking information between postage meter 20 and mailing machine 26, and may be used to monitor loading and removal of postage meter 20 from locking device 24.

Figure 7:
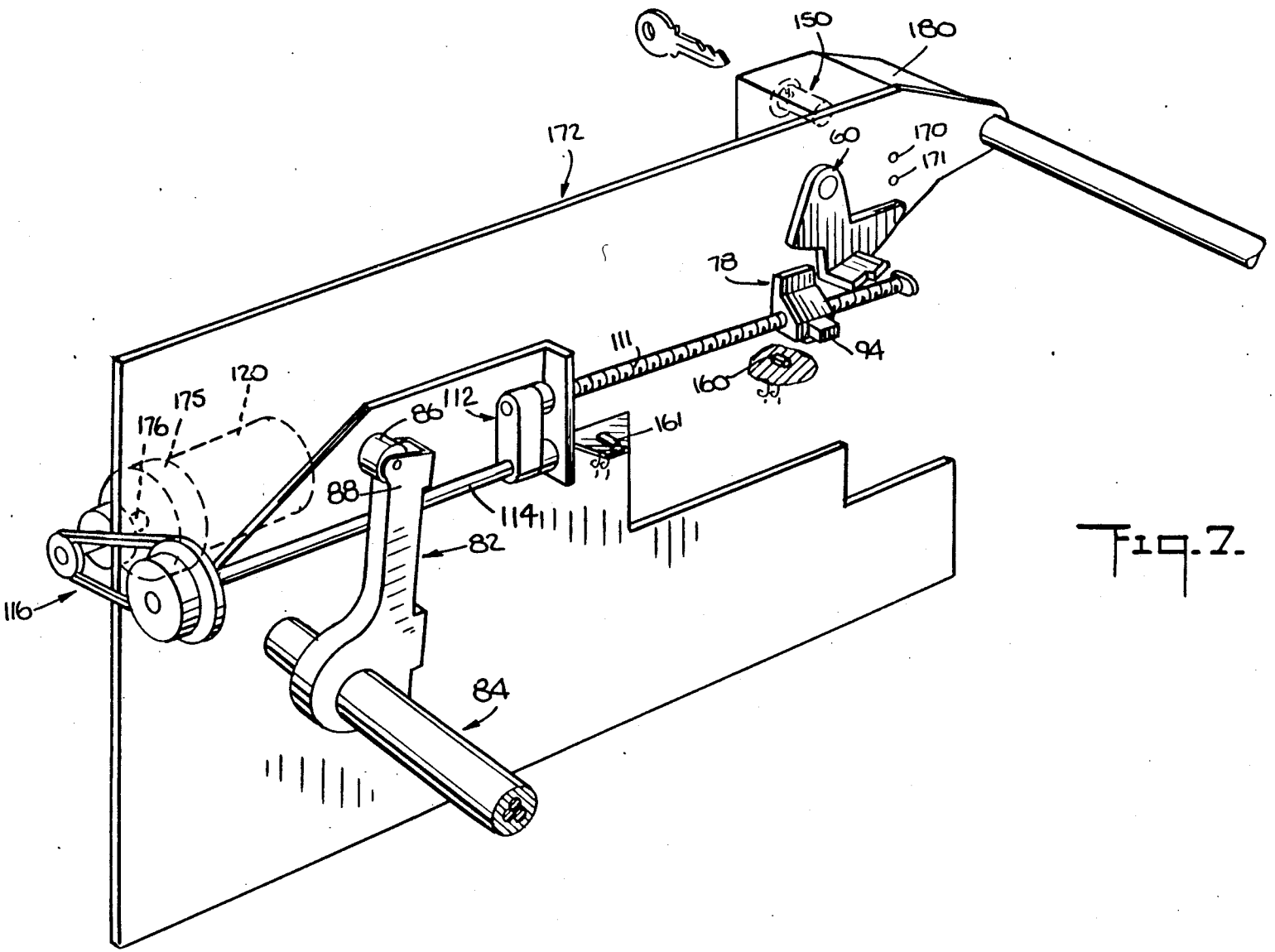
FIG. 7 is a perspective diagram showing part of a drive system of the locking device.

Referring to FIG. 3, meter pocket 22 is mounted to locking device 24 by a counterbalance mechanism 80 which includes counterbalance arm 82 fixed to torsion bar 84 (FIG. 7). Pivoting of arm 82 torsions the torsion bar 84 which resists pivoting and urges arm 84 back to its rest position depicted in FIG. 3. Roller 86 is rotatably mounted to end 88 of arm 82 to ride along cam surface 90 of counterbalance cam 92 attached to the bottom of meter pocket 22. Referring to the sequence of FIGS. 3-5, postage meter 20 is inserted into meter pocket 20, as illustrated by FIGS. 3 and 4, and meter 20 and pocket 22 are pivoted against the force of counterbalance torsion bar 84 to lower meter 20 into locking device 24 into the position depicted in FIG. 5. Postage meter 20 and meter pocket 22 are mechanically locked in locking device 24 by engagement of cam 54 (FIG. 5) urged upwardly by the action of torsion bar 84 against cam surface 62 of latching lever 60.

Referring to FIGS. 11-13, when meter 20 and pocket 22 are pivoted into locking device 24, latching lever 60 is pivoted clockwise by pin 96 sliding along surface 100 of latching lever 60. When pin 96 slides past surface 100 (FIG. 13) and reaches surface 98, latching lever 60 pivots counterclockwise until it is engaged by pin 96 (FIG. 5). Latching lever 60 is configured and pivoted from locking device 24 to be suspended under the force of gravity in the position depicted in FIG. 13. Thus, latching lever 60 pivots from the FIG. 12 to the FIG. 13 position under the force of gravity.

Postage meter 20 is removed from locking device 24 by causing latching lever 60 to be pivoted clockwise from the FIG. 5 position, as described below, thereby permitting counterbalance torsion bar 84 to pivot counterbalance arm 82 clockwise. Clockwise pivoting of arm 82 causes counterbalance cam 93 to follow roller 86 and move meter 20 and pocket 22 to the right from the FIG. 5 position to the point 102 on camming surface 90. Cam surface 90 is configured so that meter 20 and pocket 22 rise under the action of torsion bar 84 about 1 inch after latching lever 60 is disengaged from cam 54. This indicates to an operator that meter 20 is unlocked and may be removed by further pivoting the meter to the 45 degree position depicted in FIG. 2, and withdrawing it from meter pocket 22.

Referring to FIGS. 3–5 and 7, drive mechanism 45 for moving shutter bar 40 between its open and closed positions, comprises, on each side of locking device 24, a shutter bar carrier 110, lead screw 111, belt coupler 112, shaft&: 114, belt couplers 116, 117 and drive motor 120. Bearing 121 supports lead screws 111. Shutter bar carriers 110 engage shutter bar 45 and upon rotation of lead screws 111 move shutter bar. 45. Shutter bar carriers 110 include a prong or projection 94 (FIG. 7) which is received between prongs 126 (FIGS. 1 and 2) of shutter bar 40 for engaging shutter bar 40 to move it. Shutter bar carriers 110 are threaded to lead screws 111 which are rotated by motor 120 to advance shutter bar carriers 110 along lead screws 111. Motor 120 is coupled by belt couplers 116 and 117 to drive shafts 114 on each side of locking device 24. Each drive shaft 114 is in turn coupled to a lead screw 111 by another belt coupler 112. Belt couplers 112 are used to couple lead screws 111 and shafts 114, rather than having lead screw 111 run the full distance to belt couplers 116 and 117 in order to reduce the overall length of lead screws 111. Rotation of motor 120 causes the lead screws 111 on both sides of locking device 24 to rotate in synchronism and thereby advance shutter bar carriers 110 on each side of the locking device 24. As depicted in FIG. 5, shutter bar carriers 110 are moved to the right from the broken-line wait position, through the solid line position, to the broken line open position.

Figure 8:
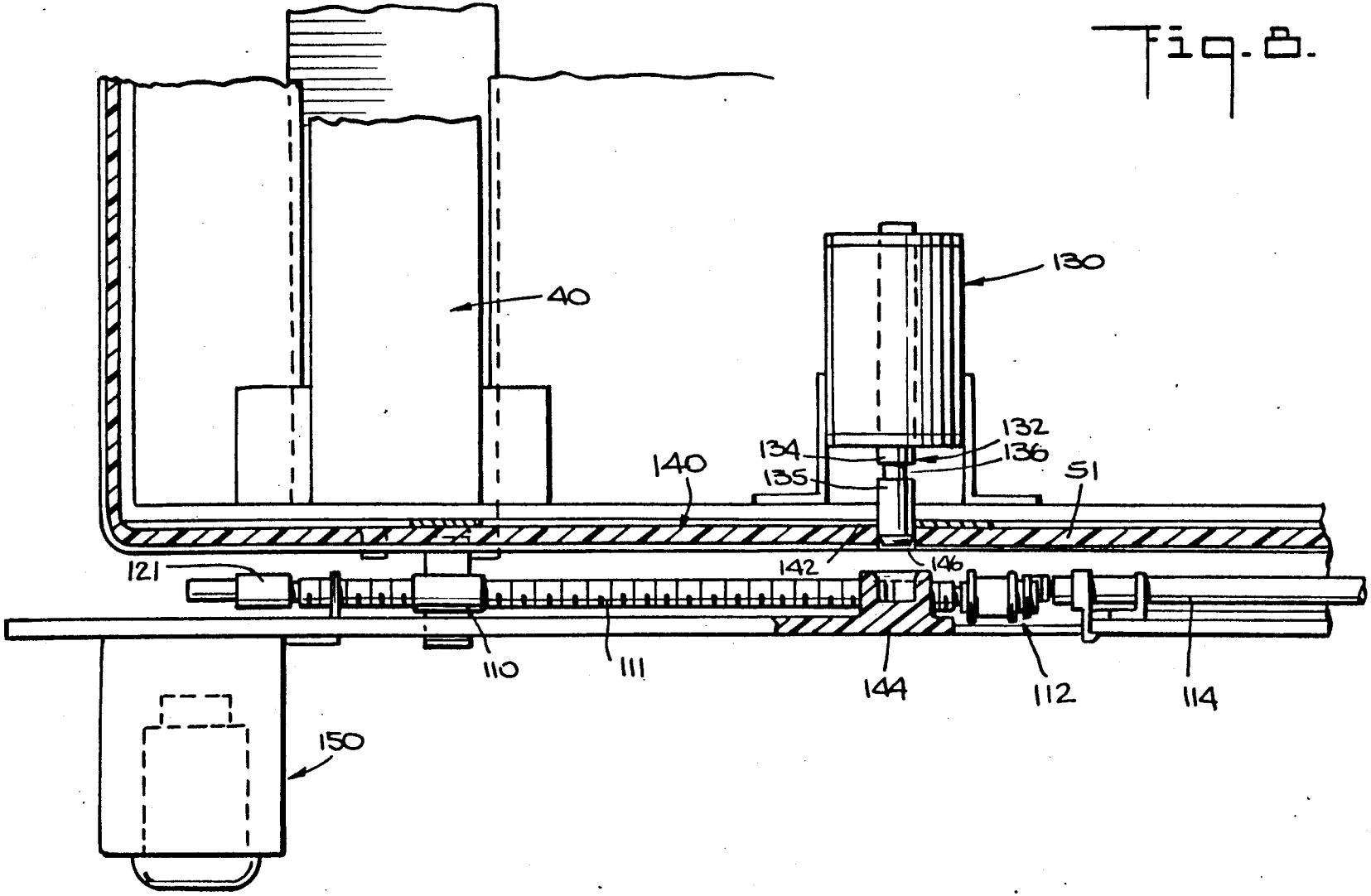
FIG. 8 is a longitudinal section view of a part of the postage meter and locking mechanism showing a locking solenoid disposed in the postage meter engaging a movable cover or shutter of the postage meter in a locking position, and a shutter carrier of a drive for moving the shutter shown in a wait position.
Figure 9:
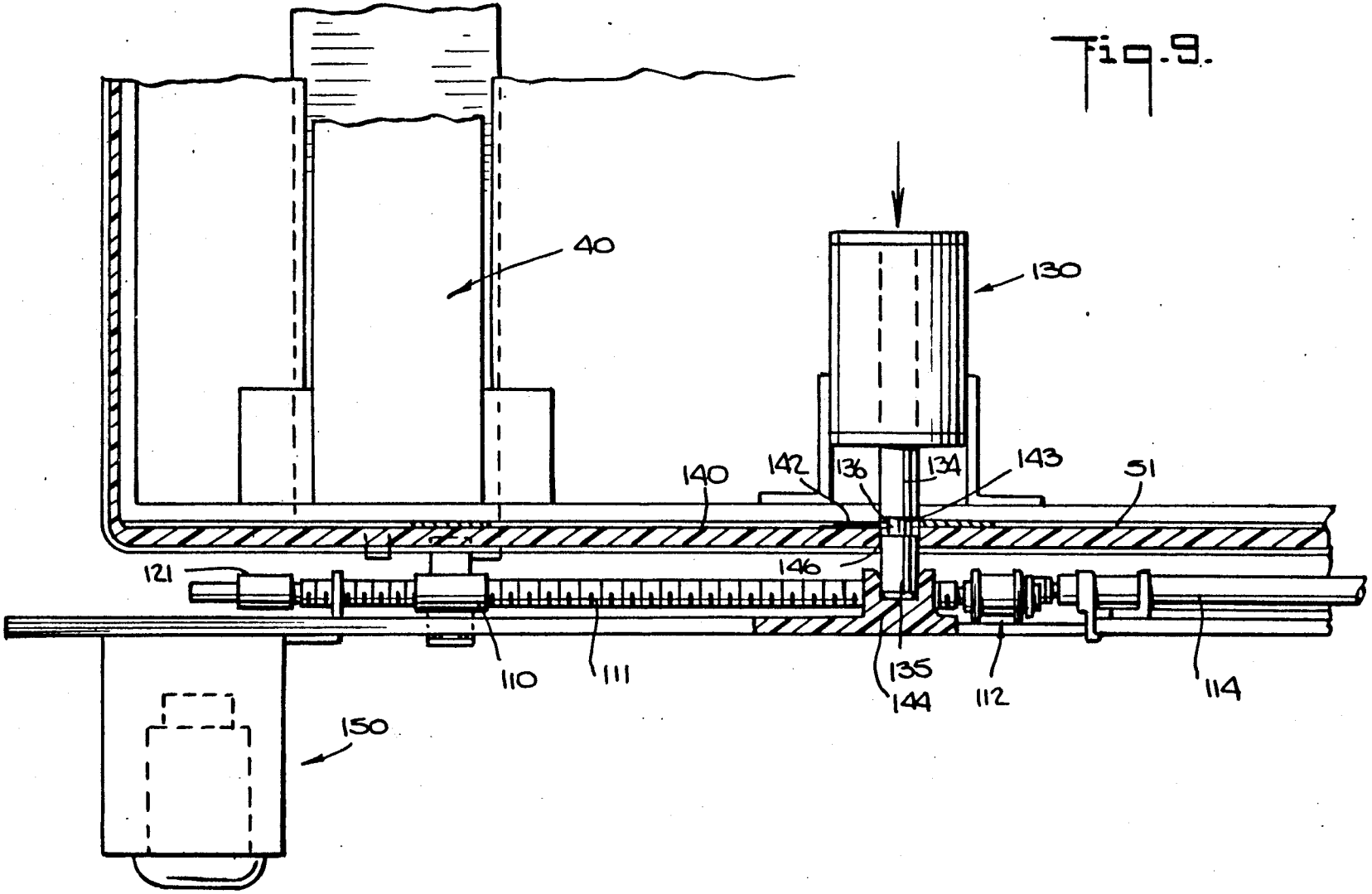
FIG. 9 is a view similar to that of FIG. 8 showing the locking solenoid in its shutter opening position and with the shutter closed and the shutter carrier in the wait position.
Figure 10:
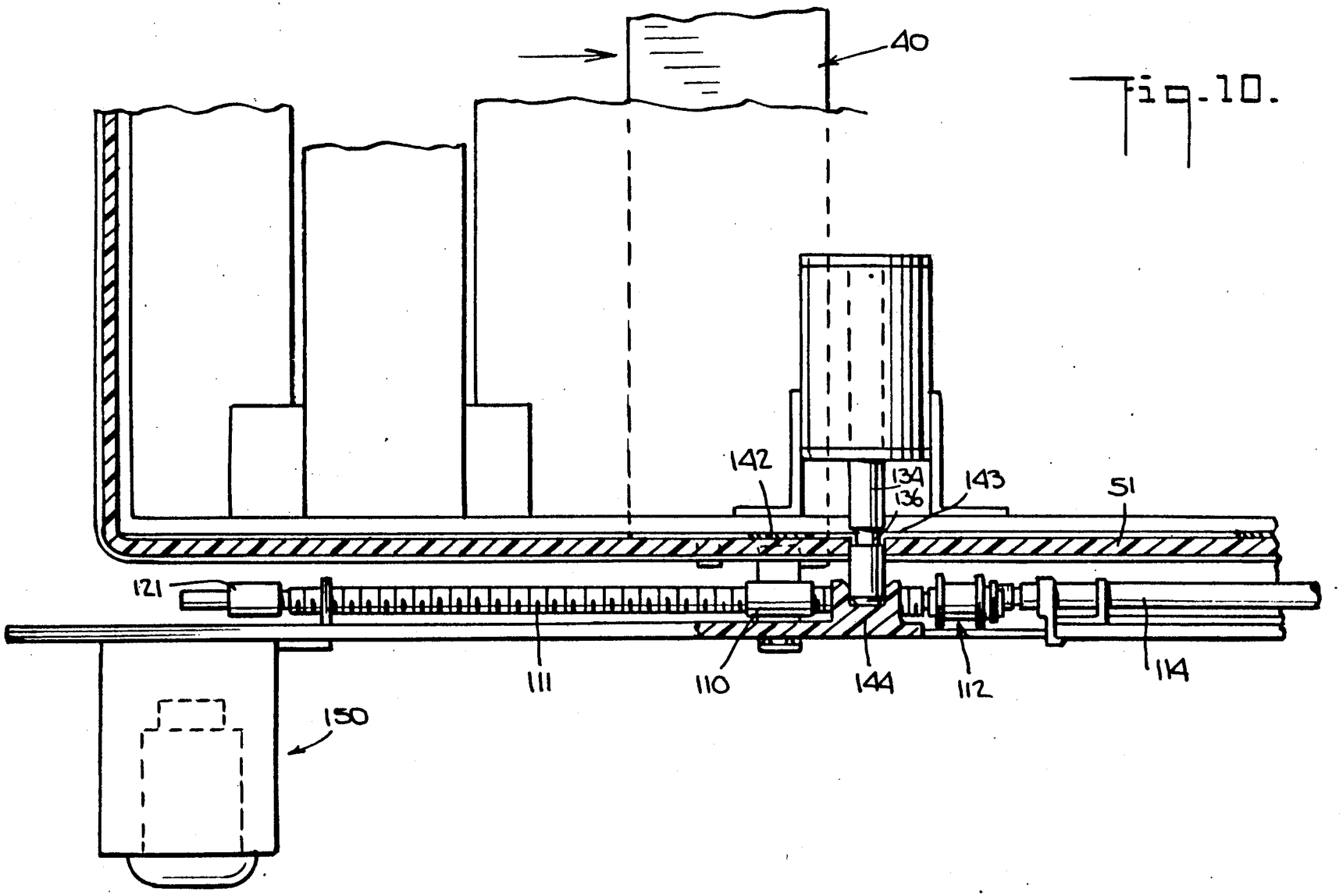
FIG. 10 is a view similar to that of FIG. 9 showing the shutter locking solenoid in its shutter opening position with the shutter open and the shutter carrier in its open position.
Figure 18:
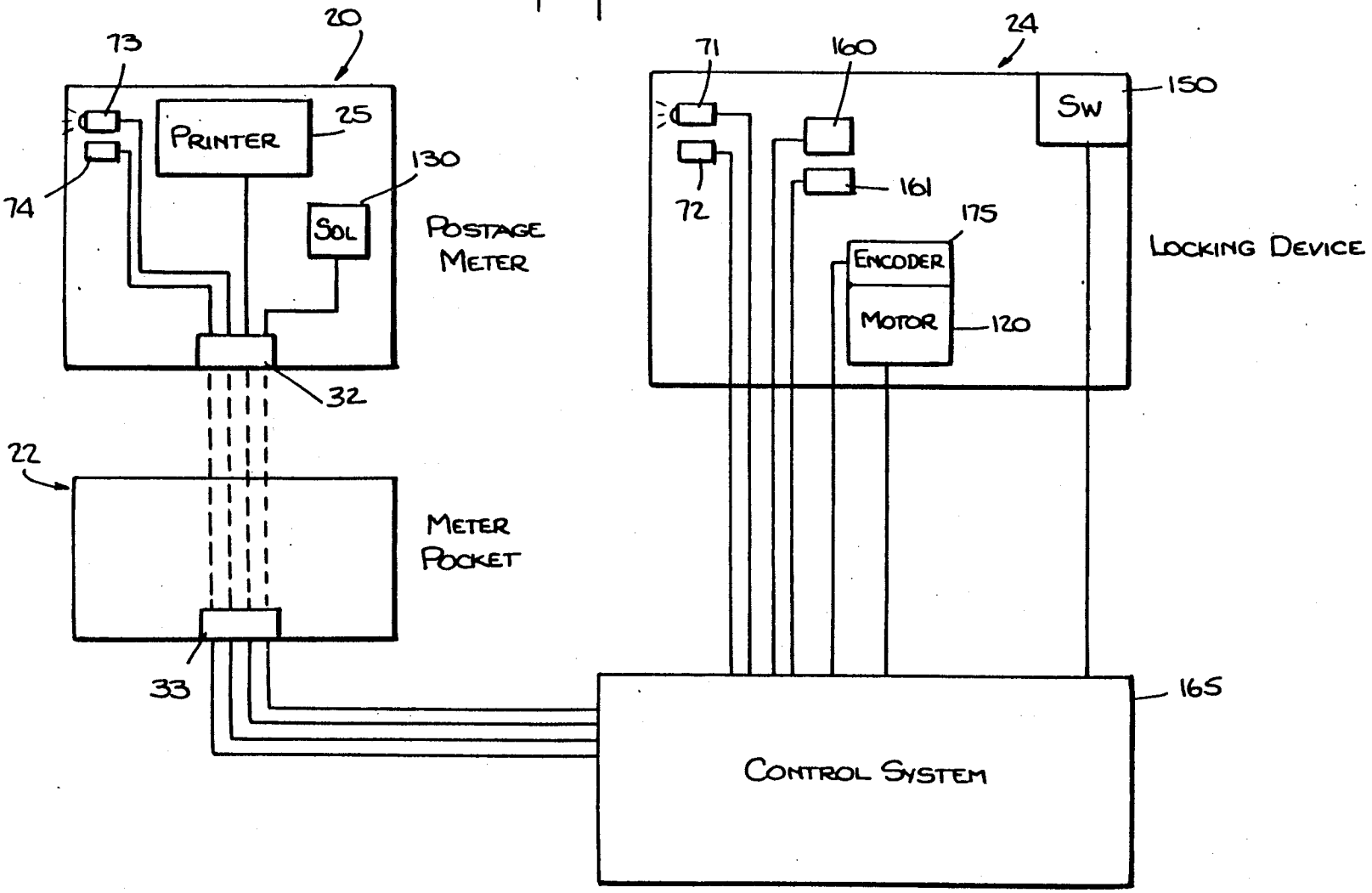

Referring to FIGS. 8–10, solenoid 130 in postage meter 20 locks shutter bar 40 in the closed position depicted in FIG. 2. Shaft 132 of solenoid 130 includes larger diameter portions 134, 135 and smaller diameter portion 136 which define are annular groove between larger diameter portions 134, 135. Attached to shutter bar 40 within meter 20 is plate 140 (FIG. 5), which extends along the inside of side 51 of meter 20 to slide therealong as shutter bar 40 is moved between its open and closed positions. Plate 140 includes a narrow slot 142 therein which includes a larger circular part 143. When the shaft of solenoid 130 is in its retraced position depicted in FIG. 8, larger diameter shaft portion 135 is aligned within the larger circular part 143 of plate 140. Thus, larger diameter shaft portion 135 engages narrow slot 142 of plate 140 to prevent sliding thereof relative to solenoid 130, and hence locks shutter bar 40 in its closed position illustrated in FIG. 8.

When solenoid 130 is energized, shaft 132 is moved outwardly of solenoid 130 as depicted in FIG. 9 to register the smaller diameter shaft portion 136 with narrow slot 142. This permits the movement of plate 140 and with it shutter bar 40 to the position depicted in FIG. 10. Larger diameter shaft portion 135 is received in a receptacle 144 in locking device 134 to precisely align smaller diameter shaft portion 126 with narrow slot 142. Meter side 51 includes a hole 146 into which larger diameter portion 135 extends to lock plate 140 (FIG. 8), and through which, it projects into receptacle 144 (FIG. 9). Shaft 132 of solenoid 130 is spring loaded so that is returns to the retracted position of FIG. 8 when power to solenoid 130 is interrupted. Thus, when power is applied to solenoid 120, shaft 122 is extended to the unlocked position depicted in FIGS. 9 and 10, and when power is interrupted, shaft 122 is retracted to the locked position depicted in FIG. 8.

Energization of drive motor 120 and solenoid 130 are controlled by key switch 150 mounted to locking device 24. Keyswitch 150 has three positions: "0", "1", "2". In the "0" position: no power is applied to drive motor 120 and solenoid 130; shutter bar 40 is locked in the closed position thereof depicted in FIG. 2; and shutter bar carrier 110 in locking device 24 is in the wait position depicted in FIGS. 3, 4 and 7–9. When switched from the "0" to the "1" position, power is applied to solenoid 130 to cause it to push shaft 132 thereof outwardly from the FIG. 8, to the FIG. 9 position. That unlocks shutter 40. At the same time, power is applied to drive motor 120 so that shutter bar 40 is transported to the open position by shutter bar carrier 110. Shutter bar 40 is opened by moving the switch key from the "0" to the "1" position, and remains in the open position any time that postage valve selection is required. Moving the switch key from position "1" to "2" turns on the power to the postage meter 20. Postage meter 20 then checks the status of alignment sensors 170 and 171. If meter 20 is aligned, then printing may occur.

When key switch 150 is moved from position "0" to position "1", power is supplied to drive motor 120 to energize it and cause shutter bar 40 to be moved by shutter bar carriers 110 from its closed position (solid lines in FIG. 2) to its open position (broken lines in FIG. 2). Postage may be imprinted as desired. For example, when used in a mailing machine, or used by itself, postage meter 20 may imprint the same postage value on a large number of items, or for an entire mail run, so that resetting of the print die for different postage valves is unnecessary.

Referring to FIG. 7, locking device 24 includes sensors 160, 161 and one of shutter carriers 78 includes a strip on its bottom surface which interacts with the sensors. In the embodiment illustrated in the drawings, sensors 160, 161 are Halleffect devices and a magnetic strip is affixed to the bottom of shutter carrier 78. Thus, the respective Hall device emits a signal when the magnetic strip is above it indicating the position of shutter carrier 78. Sensor 160 is positioned to detect shutter carrier 78 in its wait position (shutter bar 40 in its closed position) an sensor 161 is positioned to detect shutter carrier 78 in its advanced position.

Keyswitch 150 and sensors 160 and 161 are coupled to a control system 165 (FIG. 17) either in locking device 24 or in mailing machine 20 which controls energization of drive motor 120 and solenoid 130 as described herein. Optical sensors 71 and 72 (FIG. 11) and the corresponding optical sensors 73, 74 (FIG. 16) in postage meter 20 are similarly coupled to that control system 165.

In order to remove postage meter 20 from locking device 24, latching lever 60 must be disengaged from cam 54 (FIG. 13). Latching lever 60 is pivoted in a sequence that is the reverse of the sequence depicted in FIGS. 11–13 to release pin 96 from engagement with lever 60. That reverse pivoting sequence and position sensing of shutter carriers 78 and latching lever 60 are accomplished as follows.

Sensors 71 and 72 and the corresponding sensors 73, 74 in postage meter 20, in addition to providing information relating to the "x" axis and "y" axis position of postage meter 20 and performing handshaking, also provide information on the pivoted position of latching lever 60. Referring to FIG. 7, holes 170, 171 in frame 172 of locking device 24 are axially aligned with sensors 71 and 72 disposed in housing 175 of keyswitch 150 and sensors 73 and 74 disposed in postage meter 20. Holes 170, 171 are located adjacent latching lever 60 so as to be blocked by latching lever 60 when lever 60 is sufficiently pivoted. Thus, by means of holes 170 and 171, and the associated sensors, the control system may monitor pivoting of latching lever 60 during pivoting thereof, for example, in the sequence illustrated in FIGS. 11–13.

A shaft encoder 175 associated with drive motor 120 provides signals to the control system as to the angular position of motor shaft 176. Those signals used to determine the position of shutter carrier 78 after it passes sensor 160 and engages latching lever 60.

When keyswitch 150 is switched from its "1" to its "0" position, shutter carriers 110 are moved from adjacent sensor 161 to adjacent sensor 160 to move shutter bar 40 to its closed position. In order to disengage postage meter cam 54 from latching lever 60 so that postage meter 20 may be removed from locking device 24, drive motor 120 continues to advance shutter carrier 110 past sensor 160 into engagement with latching lever 60. When shutter carrier 110 is above sensor 160, sensor 160 emits a signal to control system 165. Control system 165 then accumulates signals emitted by the shaft encoder to track the further advance of shutter carrier 110. Shutter carrier 110 is advanced a predetermined distance to pivot latching lever 60 and also holes 170 and 171 are blocked by lever 60, which is sufficient to disengage cam 54 from lever 60 to release postage meter 20 as described above. When holes 170, 171 are blocked, control system 165 detects same and turns off the printer system to prevent accidental printing of postage. Pulses from shaft encoder 176 are again accumulated, and when the count is the same as the count at which motor 120 was reversed, motor 120 is stopped. This accurately repositions shutter carrier 78 in the wait position, ready for the next loading and locking of postage meter 20.

Key switch 150 is constructed so that the key may be withdrawn in the "0" and "1" positions, but not in the "2" position. It is desirable not to be able to withdraw the key when switch 150 is in the "2" position to clearly indicate to an operator that shutter bar 40 is in the open position and that the postage meter is at a position of printing postage.

Referring to FIG. 14, key switch 150 incorporates security structure to inhibit tampering and to clearly provide a visual indication of tampering. Key switch 150 includes a housing 180 which is secured to locking device 24 by break-off screws 182 (FIG. 15). Break-off screws 182 include a slotted head 184 which receives a screwdriver to permit screw 182 to be tightened, and a smooth head 185. Head 184 is connected to head 185 by a weakened shaft 186. Screw thread 187 is attached to head 185. After screw 182 is tightening, the slotted head 184 is torqued until weakened shaft 186 is sheared and slotted head 184 is separated from the screw. Smooth head 185 remains which can not be turned to prevent unscrewing. Therefore, housing 180 cannot be removed from locking device 24. Additionally, housing 180 is made of a deformable material such as plastic so that attempts to either remove it or break into it will be readily apparent.

Referring to FIG. 16, control system 165 is coupled to postage meter 20 through connector 33 of meter pocket 22 and connector 32 of postage meter 20. Specifically, sensors 73 and 74 and solenoid 130 are coupled to control system 165. Locking device 24 is also coupled to control system 165. Specifically, sensors 160, 161, sensors 71, 72, drive motor 120, shaft encoder 175 and keyswitch 150 are coupled to control system 165.

Control system 165 receives information from sensors 71–74, 160 and 161 and from keyswitch 150, and controls energization of solenoid 130 to lock and unlock shutter bar 40. Control system 165 receives information from sensors 71–74 and determines whether postage meter 20 is properly in locking device 24 and when postage meter 20 has been inserted into and removed from locking device 24. Control system 165 receives information from keyswitch 150, 71, 72 and 160, and from shaft encoder 175, and controls drive motor 120 to cause latching lever 60 to be pivoted to release postage meter 20 from locking device 24, and to return shutter carriers 110 to the wait position. Control system 165 receives information from keyswitch 150 and sensors 160 and 161 to control drive motor 120 to move shutter carriers 110 to positions corresponding to the open and closed positions of shutter bar 40.

Control system 165 may be constructed as described in the cited related applications to control functions described therein, and/or control system 165 may be constructed by those of skill in the art to perform functions described herein from the disclosure herein.

Certain changes in modifications of the embodiments of the invention herein disclosed will be readily apparent to those skilled in the art. Moreover, uses of the invention other than in postage meters and mailing machines will also be readily apparent to those with skill in the art. It is the applicants, intention to cover by the claims all such uses and all such changes and modifications which could be made to the embodiments of the inventions herein chosen for the purposes of disclosure which do not depart from the spirit and scope of the invention.

We claim:

1. A combination comprising a postage meter receptacle and a postage meter insertable therein and removable therefrom;

said postage meter comprising a housing, a printing device disposed in said housing, an aperture in said housing exposing said printing device, a cover for said aperture, means mounting said cover to said postage meter for movement of said cover from a closed position in which said cover is disposed at said aperture and an open position in which said cover is disposed away from said aperture, said cover being structured to prevent access to said printing device through said aperture when said cover is in said closed position and to permit access to said printing device when said cover is in said open position;

said receptacle including first engaging means for engaging said cover in a predetermined position of said postage meter, and driving means for driving said first engaging means to move said cover between said closed and open positions thereof.

2. The combination of claim 1 wherein said receptacle comprises first and second receptacle parts and means for coupling said first and second receptacle parts together such that said first receptacle part is pivotal between a first position thereof in which said first receptacle part forms an angle with said second receptacle part and a second position thereof in which said first receptacle part is within said second receptacle part, said first receptacle part including means for receiving a first end of said postage meter therein when said first receptacle part is in said first position, and said second receptacle part including second engaging means for engaging a second end of said postage meter therein when said first receptacle part is in its second position within said first receptacle part.

3. The combination of claim 2 wherein said first engaging means and said driving means are mounted to said second receptacle part.

4. The combination of claim 1 including locking means disposed in said postage meter for selectively locking said cover in said closed position thereof, said locking means being actuable with a signal coupled to said locking means from an exterior of said postage meter.

5. A combination as claimed in claim 4 further comprising a key activated switch fixably mounted to said postage meter receptacle for enabling operation of said postage meter and for locking said postage meter in said postage meter receptacle and tamper resistant means made of a material having characteristics which provide a visual indication of attempted tampering with said key activated switch.

6. A combination as claimed in claim 5 wherein said material is a plastic material.

7. A combination as claimed in claim 5 wherein said tamper resistant means comprise at least one fastener having structure for applying the fastener which structure is severed after application of the fastener to prevent removal of the fastener.

8. The combination comprising a postage meter locking device, a postage meter insertable therein and removable therefrom, and a control system;

said postage meter comprising a housing, a printing device disposed in said housing, an aperture in said housing exposing said printing device, a cover for said aperture, means mounting said cover to said postage meter for movement of said cover from a closed position in which said cover is disposed at said aperture and an open position in which said cover is disposed away from said aperture, said cover being structured to prevent access to said printing device through said aperture when said cover is in said closed position and to permit access to said printing device when said cover is in said open position;

said locking device including means for locking said postage meter therein in a predetermined position thereof, first engaging means for engaging said cover in said predetermined position of said postage meter, and driving means for driving said first engaging means to move said cover between said closed and open positions thereof;

said control system comprising means for determining when said postage meter is locked in said predetermined position and means for controlling said driving means, said controlling means permitting said driving means to move said cover only when said postage meter is locked in said predetermined position.

9. The combination comprising a postage meter receptacle, a postage meter insertable therein and removable therefrom, and a control system;

said postage meter comprising a housing, a printing device disposed in said housing, an aperture in said housing exposing said printing device, a cover for said aperture, means mounting said cover to said postage meter for movement of said cover from a closed position in which said cover is disposed at said aperture and an open position in which said cover is disposed away from said aperture, said cover being structured to prevent access to said printing device through said aperture when said cover is in said closed position and to permit access to said printing device when said cover is in said open position;

said postage meter receptacle including means for receiving said postage meter therein in a predetermined position thereof, first engaging means for engaging said cover in said predetermined position of said postage meter, and driving means for driving said first engaging means to move said cover between said closed and open positions thereof;

said control system comprising a key settable switch having a plurality of switch positions set by a key and means for controlling said driving means in response to said positions of said switch, said controlling means causing said driving means to move said cover from said closed position to said open position when said postage meter is in said predetermined position and said switch is switched from a first state thereof to a second state thereof.

10. A combination comprising a postage meter locking device, a postage meter insertable therein and removable therefrom and a control system;

said postage meter comprising a housing, a printing device disposed in said housing, an aperture in said housing exposing said printing device, a cover for said aperture, means mounting said cover to said postage meter for movement of said cover from a closed position in which said cover is disposed at said aperture and an open position in which said cover is disposed away from said aperture, said covering being structured to prevent access to said printing device through said aperture when said cover is in said closed position and to permit access to said printing device when said cover is in said open position;

said postage meter locking device including receiving means for receiving said insertable postage meter and locking means for locking said postage meter therein in a predetermined position thereof, first engaging means for engaging said cover in said predetermined position of said postage meter, driving means for driving said first engaging means to move said cover between said closed and positions thereof and means for actuating said locking means to lock and unlock said postage meter;

said control system comprising a key settable switch having a plurality of switch positions set by a key, means for controlling said driving means in response to said positions of said switch, said controlling means causing said driving means to move said cover from said closed position to said open position when said postage meter is in said predetermined position and said switch is switched from a first state thereof to a second state thereof, and means for controlling said actuating means to cause said actuating means to unlock said postage meter when said switch is switched to said first state thereof from another state thereof.

11. The combination of claim 10 including locking means disposed in said postage meter for selectively locking said cover in said closed position thereof, said locking means being actuable by said control system when said switch is switched from said first state to another state thereof.

* * * * *